US010722006B2

(12) United States Patent
Christian et al.

(10) Patent No.: US 10,722,006 B2
(45) Date of Patent: Jul. 28, 2020

(54) DEVICE FOR ADJUSTING THE LENGTH OF A BRACELET

(71) Applicant: ROLEX SA, Geneva (CH)

(72) Inventors: Martin Christian, Eteaux (FR); Philippe Di Piazza, Ville-la-Grand (FR); Teddy Grivet, Gex (FR)

(73) Assignee: ROLEX SA, Geneva (CH)

( * ) Notice: Subject to any disclaimer, the term of this patent is extended or adjusted under 35 U.S.C. 154(b) by 47 days.

(21) Appl. No.: 15/830,703

(22) Filed: Dec. 4, 2017

(65) Prior Publication Data

US 2018/0153267 A1 Jun. 7, 2018

(30) Foreign Application Priority Data

Dec. 5, 2016 (EP) ..... 16202129

(51) Int. Cl.
*A44C 5/24* (2006.01)

(52) U.S. Cl.
CPC ..... *A44C 5/246* (2013.01)

(58) Field of Classification Search
CPC .. A44C 5/246; Y10T 24/2155; Y10T 24/4782
See application file for complete search history.

(56) References Cited

U.S. PATENT DOCUMENTS 2,997,761 A * 8/1961 Davis ..... A44B 11/28 24/68 R
5,038,557 A 8/1991 Otsuki et al.
5,689,861 A 11/1997 Petignat
5,771,543 A 6/1998 Froidevaux et al.
(Continued)

FOREIGN PATENT DOCUMENTS

CH 702 524 A2 7/2011
EP 0 819 391 A1 1/1998
(Continued)

OTHER PUBLICATIONS

European Search Report and Written Opinion dated Apr. 24, 2017 issued in counterpart application No. EP16202129; w/ English partial translation and partial machine translation (13 pages).
(Continued)

*Primary Examiner* — Robert Sandy
*Assistant Examiner* — Rowland Do
(74) *Attorney, Agent, or Firm* — Seckel IP, PLLC

(57) ABSTRACT

Device for adjusting the length of a bracelet, having a guidance and fastening system (10, 30, 40, 50), including at least one adjusting link element (23) mounted with the ability to rotate about an axis of rotation (A1) defined by a guidance device of the guidance and fastening system. The guidance and fastening system (10, 30, 40, 50) includes an elastic fastening device comprising an elastic property in order to perform an elastic fastening function. The two guidance and elastic fastening devices are arranged around the axis (A1), notably upon implementation of the fastening function. The elastic fastening device provides elastic immobilization of an end link element (25) connected to the adjusting link element (23), particularly relative elastic immobilization of the said end link element (25) with respect to the adjusting link element (23), or of the adjusting link element (23), in at least one configuration of the adjustment device.

21 Claims, 10 Drawing Sheets

(56) References Cited

U.S. PATENT DOCUMENTS

| | | | | |
|---|---|---|---|---|
| 6,026,637 | A | 2/2000 | Dombre et al. | |
| 6,073,316 | A | 6/2000 | Ferrario et al. | |
| 6,094,782 | A | 8/2000 | Gay et al. | |
| 6,098,394 | A | 8/2000 | Hashimoto et al. | |
| 6,119,315 | A | 9/2000 | Gay | |
| 6,185,799 | B1 | 2/2001 | Gay | |
| 6,401,307 | B1 | 6/2002 | Wild | |
| 6,488,404 | B2 | 12/2002 | Zürcher et al. | |
| 6,494,030 | B2 | 12/2002 | Cazard | |
| 7,043,895 | B2 | 5/2006 | Mace | |
| 7,303,330 | B2 | 12/2007 | Hartzband | |
| 8,001,658 | B2 | 8/2011 | Christian et al. | |
| 8,418,325 | B2 | 4/2013 | Lemosquet et al. | |
| 8,739,369 | B2 | 6/2014 | Kaltenrieder et al. | |
| 8,789,245 | B2 | 7/2014 | Leger | |
| 8,910,348 | B2 | 12/2014 | Schenk | |
| 9,049,906 | B2 * | 6/2015 | Schmidt | A44C 5/246 |
| 9,282,792 | B2 | 3/2016 | Mace et al. | |
| 9,635,911 | B2 * | 5/2017 | Moille | A44C 5/185 |
| 2006/0090305 | A1 * | 5/2006 | Aquillon | A44C 5/2042 24/265 WS |
| 2007/0125123 | A1 | 6/2007 | Sierro | |
| 2008/0083101 | A1 | 4/2008 | Christian et al. | |
| 2014/0101893 | A1 * | 4/2014 | Dornhege | G04B 37/1493 24/3.2 |

FOREIGN PATENT DOCUMENTS

| | | | |
|---|---|---|---|
| EP | 1 790 247 | A1 | 5/2007 |
| EP | 1 908 366 | A1 | 4/2008 |
| EP | 2 601 855 | A1 | 6/2013 |

OTHER PUBLICATIONS

Office Action dated May 3, 2019 in co-pending U.S. Appl. No. 15/830,711 (with PTO892, without returned SB08) (total 9 pages).

European Search Report and Written Opinion dated Apr. 12, 2017 issued in European application No. EP16202133, counterpart of co-pending U.S. Appl. No. 15/830,711; w/ English partial translation and partial machine translation (15 pages). (D2 EP1790247 and D3 EP0819391 cited in the ESR are not listed in this IDS since they were already listed in the IDS filed Dec. 4, 2017).

* cited by examiner

DEVICE FOR ADJUSTING THE LENGTH OF A BRACELET

This application claims priority of European patent application No. EP16202129.9 filed Dec. 5, 2016, the content of which is hereby incorporated by reference herein in its entirety.

The present invention relates to a device for adjusting the length of a bracelet, comprising a particular guidance and fastening system for a bracelet, particularly suited to a wristwatch bracelet provided with an extension device and/or provided with a deployment clasp fitted between two ends of the bracelet. It also relates to a clasp and to a bracelet per se, incorporating such a length adjustment device of a bracelet, and to a wristwatch per se comprising such a device.

PRIOR ART

There are several situations in which it is necessary to perform guidance and fastening functions on a bracelet, notably of a wristwatch, particularly in a device for adjusting the length of a bracelet.

For example, a clasp, designed to fasten the two bands of a watch bracelet around the wrist of its wearer, comprises several articulated leaves which are able to occupy a closed first position, in which a fastening function is required in order to stabilize this closed position, and an open second position, in which the leaves are no longer fastened and allow the bracelet to be put on or taken off.

Furthermore, a clasp is generally provided with a first adjustment of its positioning relative to the bracelet, referred to as conventional adjustment. However, the final length obtained is often imperfect and not optimal.

For that reason, existing clasps are equipped with a solution that allows a second adjustment to be made to the length of the bracelet, this also being referred to as a comfort adjustment, to complement the conventional first adjustment. Document EP0819391 describes such a solution, which relies on an adjusting link which pivots and can occupy two stable positions that impose two different lengths on the bracelet. The short position is maintained by a notch of an end link of the bracelet, which catches and elastically immobilizes against the adjusting link in its short position. Such a solution therefore requires the articulation of several links and the fastening of a link in order to guarantee stability in the short position.

Other clasps, like the one described in document EP2601855, incorporate an extension system designed for sub-aqua use. Such a solution likewise entails the implementation of the two guidance and fastening functions in order to obtain the extension effect.

Finally, the above examples illustrate that there are numerous bracelet solutions, which employ articulations and elastic fastenings, particularly in a length adjustment device.

It is an overall objective of the invention to offer a guidance and fastening solution intended for adjusting the length of a bracelet, which improves the existing solutions, which notably optimizes the two guidance and fastening functions.

More particularly, the invention proposes a solution for adjusting the length of a bracelet, or even a solution for fastening a bracelet, which is reliable in its operation and convenient to manipulate.

More particularly, one objective of the invention is to offer a guidance and fastening solution for a bracelet, which makes it possible to achieve reliable operation of the two guidance and elastic fastening functions.

A second objective of the invention is to offer a guidance and fastening solution for a bracelet, which guarantees the aesthetic integrity of a bracelet.

BRIEF DESCRIPTION OF THE INVENTION

To this end, the invention relies on a device for adjusting the length of a bracelet, comprising a guidance and fastening system, wherein it comprises at least one adjusting link element mounted with the ability to rotate about an axis of rotation defined by a guidance device of the said guidance and fastening system, this guidance and fastening system further comprising an elastic fastening device comprising an elastic property in order to perform an elastic fastening function, these two guidance and elastic fastening devices both being arranged around the said axis, notably upon implementation of the fastening function, and wherein the elastic fastening device provides elastic immobilization of an end link element connected to the adjusting link element, particularly relative elastic immobilization of the said end link element with respect to the adjusting link element, in at least one configuration of the adjustment device.

The invention also relies upon a guidance and fastening system for a bracelet, wherein it comprises a guidance device able to implement a guidance function and an elastic fastening device able to perform an elastic fastening function, and wherein these two guidance and elastic fastening devices are arranged about the one same axis, notably upon implementation of the fastening function.

The invention is more specifically defined by the claims.

BRIEF DESCRIPTION OF THE FIGURES

These objectives, features and advantages of the invention will be described in detail in the following description of nonlimiting particular embodiments given with reference to the appended figures, in which.

For the sake of simplicity, the description will, by convention, use the terms "longitudinal direction" to denote the direction along the length of a bracelet band or of a clasp, and "transverse direction" to denote the perpendicular direction, in the plane of a bracelet band (across its width) or of a clasp. The vertical direction is the direction perpendicular to the first two directions, oriented perpendicular to the plane of the bracelet. Furthermore, the term "link element" will be used for an elementary component of a bracelet and the term "link" will be used for a collection of link elements. "Bracelet" will be used to denote either the bracelet in its entirety, with or without the clasp, or one or other of the bands of the bracelet. Furthermore, the same references will be used in the various embodiments to denote elements that are identical or similar or offer the same functions.

Figure 1:
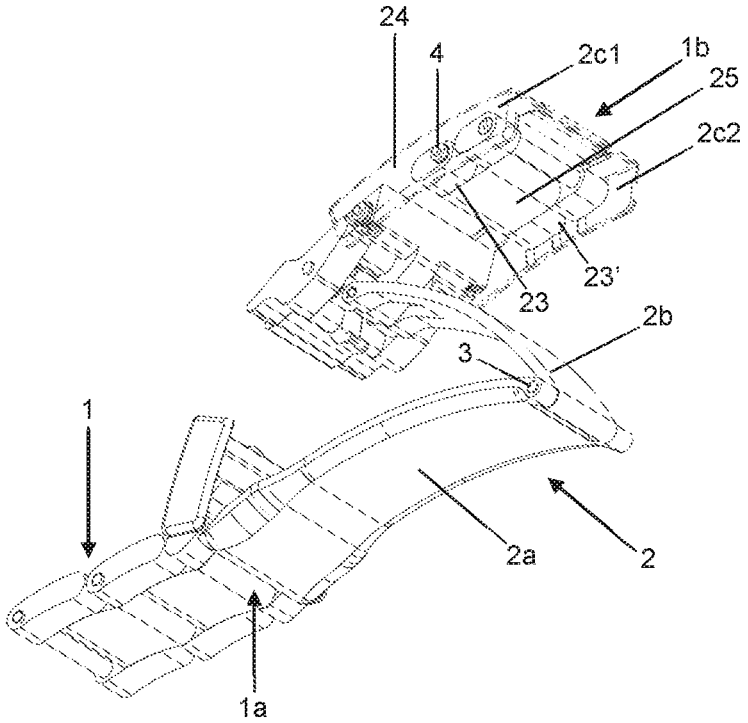
FIG. 1 depicts a perspective view of a clasp incorporating a guidance and fastening system belonging to a first embodiment of the invention.

The invention relies on a combined guidance and fastening system. The guidance and fastening system of the length adjustment device according to the first embodiment of the invention contributes to a function of adjusting the length of a bracelet within a clasp, as depicted in FIG. 1, and using an architecture similar to the solution described in document EP0819391. The end of such a bracelet is connected to a device for adjusting, particularly adjusting for comfort, the length thereof, which is configured to allow a small modification of the length of the bracelet, in addition to a conventional initial adjustment, as explained earlier.

A deployment clasp 2 comprises two leaves 2*a*, 2*b*, articulated to one another about a pin 3. One of these leaves, the leaf 2*a*, is articulated to a first end 1*a* of a bracelet 1, whereas the second end 1*b* of this bracelet is articulated to a cover 24 of the clasp provided with two parallel lateral walls 2*c*1, 2*c*2, forming a cap under which the leaves 2*a*, 2*b*, are folded. The two parallel lateral walls 2*c*1, 2*c*2 of this cover 24 comprised two series of respective bores 4, facing one another in pairs and intended to accept a pivot pin, as will be detailed hereinafter.

Figure 5:
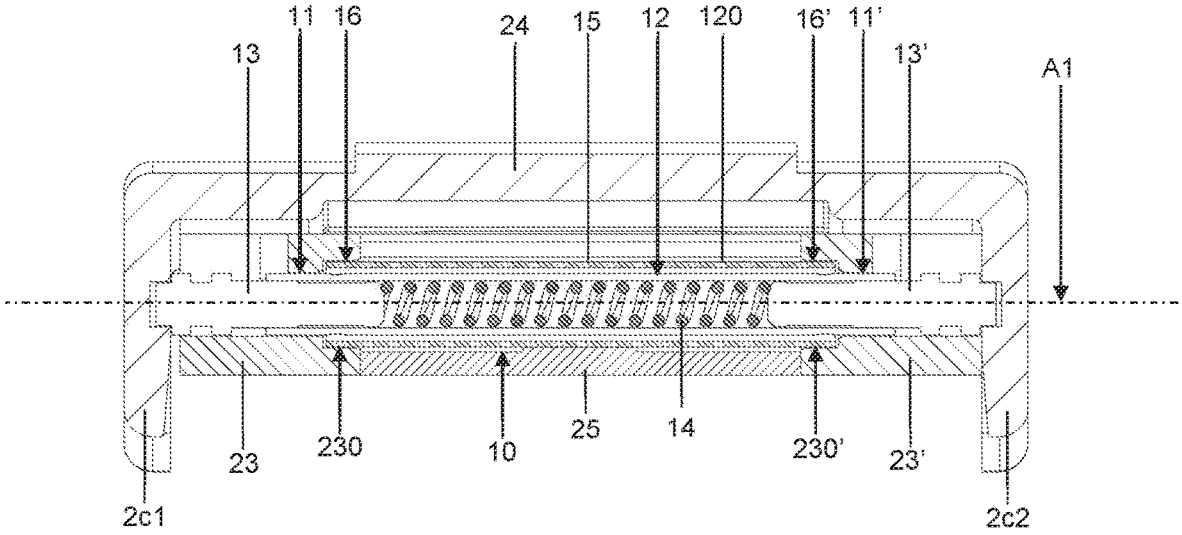
FIG. 5 depicts the clasp in cross section in the region of the guidance and fastening system belonging to the first embodiment of the invention.

The guidance and fastening system 10 belonging to this first embodiment of the invention, particularly visible in FIG. 5, is arranged at the second end 1*b* of the bracelet, about an axis A1, as will be detailed in greater detail. This guidance and fastening system first of all forms an articulation pin for the adjusting link elements 23, 23' arranged under the cover 24 of the clasp. These same adjusting link elements 23, 23' are connected by a second pivot pin 26, arranged about a second axis A2, notably visible in FIG. 2, distinct from the axis A1 of the guidance and fastening system 10, about which an end link element 25 present at the end 1*b* of the bracelet 1 is mounted with the ability to rotate.

Figure 2:
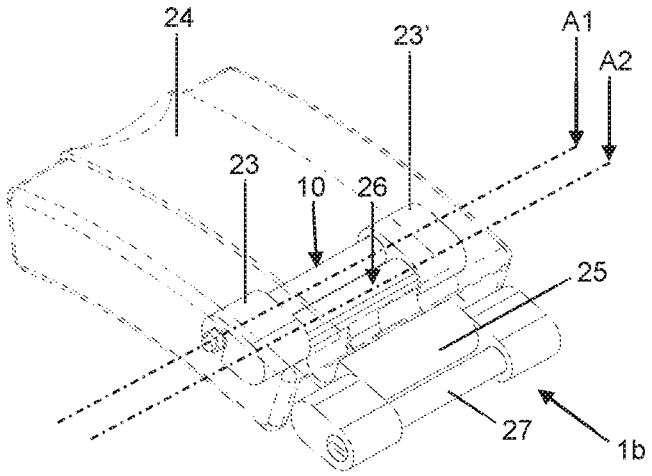
FIG. 2 depicts a perspective view of the clasp in the region of a device for adjusting the length of a bracelet incorporating the guidance and fastening system belonging to the first embodiment of the invention, in the long configuration.

FIG. 2 illustrates this arrangement at the end 1*b* of the bracelet in the long configuration. The adjusting link elements 23, 23' are positioned in such a way that the second pivot pin 26 is oriented toward the outside of the cover 24 of the clasp with respect to the first axis A1. The end link element 25 thus extends towards the bracelet, between this second pivot pin 26 and a third pin 27 positioned towards the second end 1*b*, to which the rest of the bracelet band is connected.

Figure 3:
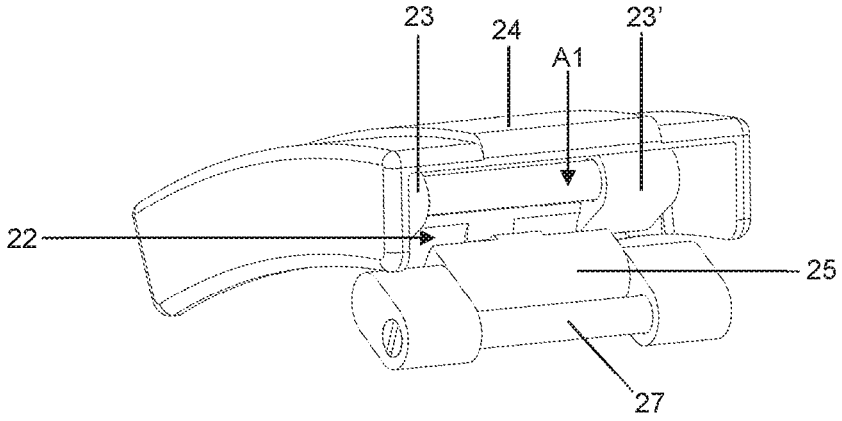
FIG. 3 depicts a perspective view of the clasp in the region of a device for adjusting the length of a bracelet incorporating the guidance and fastening system belonging to the first embodiment of the invention, in the actuation configuration.
Figure 4:
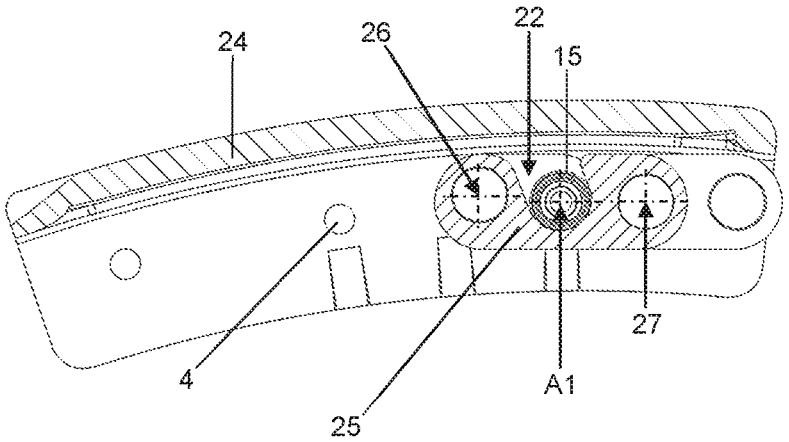
FIG. 4 depicts a perspective view of the clasp in the region of a device for adjusting the length of a bracelet incorporating the guidance and fastening system belonging to the first embodiment of the invention, in the short configuration.

FIG. 3 illustrates the same arrangement during the course of actuation, in order notably to pass from the long configuration to the short configuration. For that, the adjusting link elements 23, 23' are actuated to make them rotate around the axis A1, thus making the pivot pin 26 pivot around this axis A1, towards the inside of the cover of the clasp, driving the end link element 25 towards the inside of the cover, thus inducing a reduction in the length of the bracelet 1. This rotation of the adjusting link elements 23, 23' is continued over approximately half a turn, until the short configuration illustrated in FIG. 4 is reached.

The guidance and fastening system 10 of the length adjustment device according to the first embodiment is arranged about the axis A1 and performs the first function of articulating the adjusting link elements 23, 23' and a second function of elastic fastening allowing the aforementioned short configuration to be maintained in a stable manner, as will be detailed hereinafter.

FIG. 5 depicts the arrangement in a view in section on a vertical transverse plane in the region of the axis A1 of the guidance and fastening system 10.

The guidance and fastening system 10 first of all comprises a substantially cylindrical bar 12, extending transversely across the entire width of the clasp, arranged around the central axis A1, and comprising end pieces 13, 13' respectively, which are housed in bores 4 of the lateral walls 2*c*1, 2*c*2 of the cover 24 of the clasp. A retaining spring 14 is arranged in a tubular rod 120 between the two end pieces 13, 13', in a compressed configuration, along the axis A1, so as to allow the bar 12 to be fitted and removed and so as to keep it stable in the operating configuration. The rod 120 comprises a peripheral surface, forming a guide surface 11, 11', about which the rotation of the adjusting link elements 23, 23' is respectively arranged, notably by way of a complementary surface formed by a bore belonging to these adjusting link elements. Thus, the bar 12 forms a guidance device of the guidance and fastening system 10. The link element 23 therefore comprises a bore that is open-ended for the passage of the bar 12.

Furthermore, the guidance and fastening system comprises a spring tube 15, arranged around the bar 12, in a central position. This spring tube 15 forms a compression tube. As its axis it has the same axis A1 as the bar 12. It is therefore arranged coaxially with respect to the bar 12, which it surrounds. This spring tube 15 forms a fastening device of the guidance and fastening system 10, which performs the elastic fastening second function. In order to do so, at least one portion of the spring tube 15 is designed to be compressed under actuation of the end link element 25, more particularly under actuation of a notch 22 of this end link element 25, according to this embodiment, when the bracelet is in the short configuration. This compression of the tube causes elastic deformation of its peripheral wall in a direction substantially perpendicular to the axis A1, and therefore in the direction of the bar 12. This collaboration with the end link element 25 fastens this end link element 25 and keeps the entire arrangement stable in the short configuration. Deliberate pulling of this end link element 25, with a predetermined force, allows it to escape its elastic fastening and return to the long configuration of the bracelet.

The connection between the spring tube 15 and the bar 12 of the guidance and fastening system 10 is such that the spring tube 15 is independent of the bar 12, and vice versa. In particular, the spring tube 15 has, at each of its ends, a portion 16, 16' provided with a guide surface, which is designed to collaborate with a complementary guide surface of the adjusting link elements 23, 23', embodied for example by a bore 230, 230' of these link elements. Thus, the spring tube 15 is arranged and dimensioned in such a way that the inside diameter of the spring tube 15, once compressed, does not collide with the exterior periphery of the bar 12. It is therefore free to deform elastically, and has no impact on the bar 12, and does not impede the guidance function thereof. Conversely, the bar 12 has no influence on the elastic function of the spring tube 15 in its guidance function.

Thus, the two guidance and fastening devices of the guidance and fastening system 10 are combined with one another in such a way as to form a compact device of minimal bulkiness and which does not detract from the aesthetic appearance of the clasp or of the bracelet. They are also able to be assembled with and incorporated into the bracelet easily.

Furthermore, the two, respectively guidance and fastening, devices of the guidance and fastening system are independent of one another. That allows the elastic fastening function to be performed reliably and repeatably, independently of any potential variations in the guidance device. In addition, the elastic fastening function relies on elastic deformation of at least one spring component of the guidance and fastening system, independently of the guidance part, which means to say that this deformation has no impact on the components of the first device contributing to the guidance function. The retaining force is defined only by the elastic deformation of the spring tube 15, with no risk of plastic deformation of the bar 12 nor any risk of causing the bar 12 to flex. The retaining force is also independent of the material of the end link element 25, notably of the material of the notch 22 of the end link element 25, which collaborates directly with the spring tube 15 when the spring tube 15 is performing the fastening of the link element 25.

As is clear from the foregoing description, the independence of the guidance and fastening functions of the guidance and fastening system is obtained through physical separation of components performing these two functions. Specifically, such components are distinct, which means that different and optimized materials can be chosen for performing each function, and that each function can be performed without suffering the influence of the components used for performing the other function.

By way of example, the elements 120, 13, 13' of the guide bar 12 may be in a material of the steel grade 904L type, or in gold. The spring tube 15 may be in a spring material of Nivaflex® type, or alternatively in a superelastic alloy of nickel and titanium, such as Nitinol. The geometry of the tube may of course be adapted in order to optimize its mechanical properties. For example, the tube may be split, notably on each side, or alternatively have one or more cutouts. To complement this, the elastic fastening function is also independent of the materials used for the adjusting link elements and the end link element. Thus, the retaining force generated by the fastening function is constant over time, whatever the bracelet used. By way of example, the link elements of the bracelet collaborating with the guidance and fastening system, notably the adjusting link element or elements and the end link element may be made of steel grade 904L, of gold, or alternatively of platinum.

FIGS. 6 to 9 illustrate a guidance and fastening system 10 of a length adjustment device according to a second embodiment of the invention. This device is likewise incorporated into a clasp cover 24 and participates in adjusting the length of the bracelet. This adjustment differs from the solution described with reference to the first embodiment notably in that the guidance and fastening system 10 belonging to the first embodiment is able to move in longitudinal grooves or guideways 6 arranged in the vertical walls 2*c*1, 2*c*2 of the cover 24.

Figure 6:
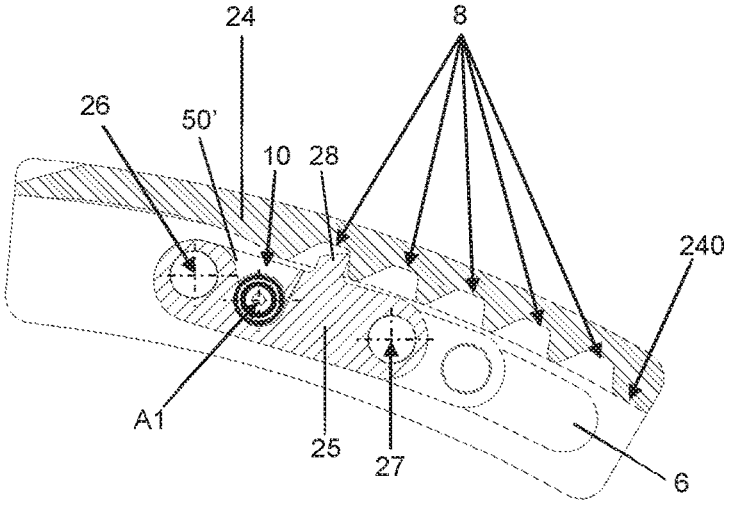
FIG. 6 depicts a clasp in longitudinal section in the region of a device for adjusting the length of a bracelet in the short configuration incorporating a guidance and fastening system belonging to a second embodiment of the invention.
Figure 7:
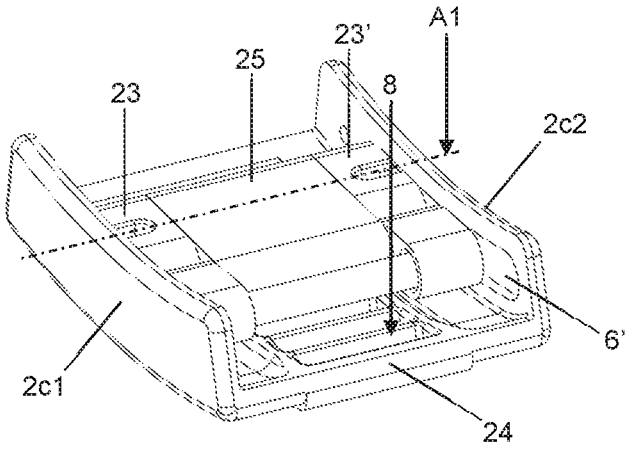
FIG. 7 depicts a perspective view of the clasp in the region of a device for adjusting the length of a bracelet incorporating the guidance and fastening system belonging to the second embodiment of the invention, in the short configuration.

FIGS. 6 and 7 illustrate the arrangement of the bracelet in the short configuration. Lateral adjusting link elements 23, 23' are positioned in such a way that the second pivot pin 26 is oriented toward the inside of the cover 24 of the clasp with respect to the first axis A1. The end link element 25 of the bracelet and the pivot pin 26 are thus in a set-back position facing the end 1*b* of the bracelet. Unlike in the embodiment described hereinabove, the end link element 25 comprises a finger 28 collaborating with a toothset 8 arranged in the bottom 240 of the cover, to block the movement, corresponding more or less to a translational movement, of the bracelet length adjustment device. The teeth of this toothset 8 define several positions for the end link element 25 of the bracelet facing the cover 24 of the clasp and, therefore, several bracelet lengths. In FIGS. 6 and 7, the finger 28 collaborates with the first tooth of the toothset 8 from the inside of the cover 24, which corresponds to the shortest bracelet position.

Figure 8:
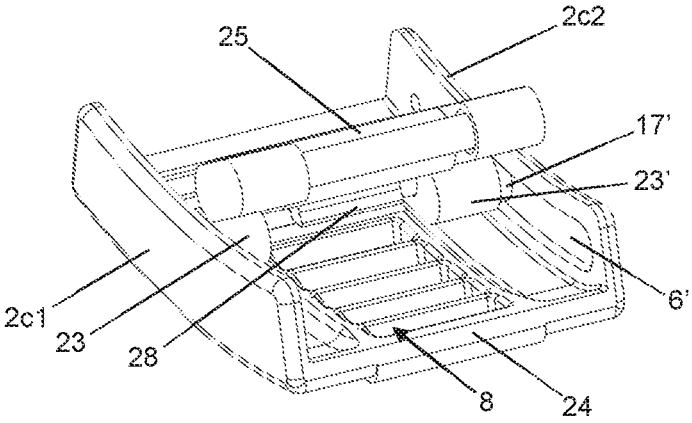
FIG. 8 depicts a perspective view of the clasp in the region of a device for adjusting the length of a bracelet incorporating the guidance and fastening system belonging to the second embodiment of the invention, in the actuation configuration.

FIG. 8 illustrates the adjustment device during the course of actuation, in order to perform a length adjustment. The end link element 25 of the bracelet is turned by hand about its pivot pin 26 arranged between the adjusting link elements 23, 23', with a predetermined force allowing it to be disengaged from its elastic fastening in the fastening device of the guidance and fastening system, while at the same time releasing its finger 28 from the toothset 8 of the cover of the clasp. The adjustment device is thus free to move longitudinally in the lateral grooves of the clasp. When a satisfactory bracelet length is reached, the end link element 25 is folded down towards the bottom 240 of the cover, so that it fastens elastically in the fastening device of the guidance and fastening system 10, while at the same time its longitudinal position is immobilized by the positioning of its finger 28 in a new tooth of the toothset 8 of the clasp.

Figure 9:
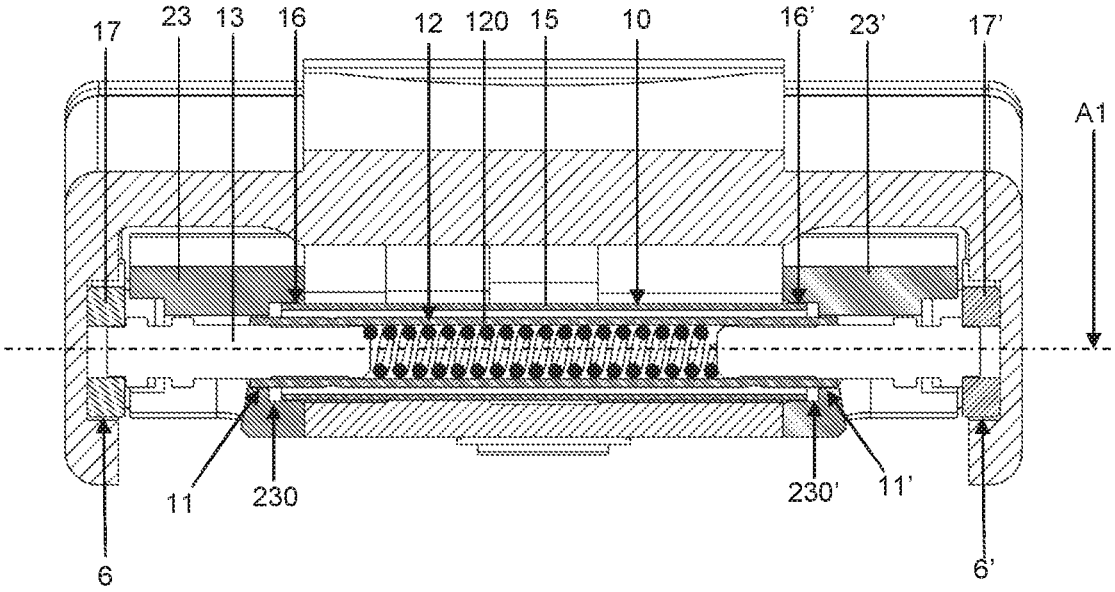
FIG. 9 depicts the clasp in cross section in the region of the guidance and fastening system belonging to the second embodiment of the invention.

The guidance and fastening system 10 is more particularly illustrated in the cross section of FIG. 9. This guidance and fastening system 10 is very similar to that of the first embodiment. It comprises a bar 12, which differs from the bar of the first embodiment in that it is guided, at its lateral ends, by pads 17, 17' housed in grooves arranged longitudinally in the vertical walls 2*c*1, 2*c*2 of the cover 24. Thus, the bar 12 can be guided by the grooves in a movement which follows the curvature of the cover 24, and which approximates to a longitudinal translation.

A spring tube 15 is arranged coaxial with the bar 12, in a similar way to the first embodiment. The link element 25 may also comprise a notch 22 the shaping of which is designed to generate adequate compression forces on the spring tube 15.

In the manner of the device belonging to the first embodiment, the connection between the spring tube 15 and the bar 12 of the guidance and fastening system 10 is such that the spring tube 15 is independent of the bar 12, and vice versa. In particular, the spring tube 15 has, at each of its ends, a portion 16, 16' provided with a guide surface, which is designed to collaborate with a complementary guide surface of the adjusting link elements 23, 23', embodied for example by a bore 230, 230' of these link elements. Thus, the spring tube 15 is arranged and dimensioned in such a way that the inside diameter of the spring tube 15, once compressed, does not collide with the exterior periphery of the bar 12. It is therefore free to deform elastically, has no impact on the bar 12, and does not impede the guidance function thereof. Conversely, the bar 12 has no influence on the elastic function of the spring tube 15 in its guidance function.

In the two first embodiments of the length adjustment device, guidance of the spring tube 15 by the adjusting link elements 23, 23' can be performed with a defined amount of play such that the spring tube 15 can be driven in rotation or not under the effect of the notch, before and/or during compression of the spring tube 15.

FIGS. 10 to 14 illustrate a guidance and fastening system 30 belonging to a third embodiment of the length adjustment device, which is similar to the one depicted in FIG. 1. The bracelet length adjustment device works in a similar way to the one described with reference to the first embodiment.

Figure 10:
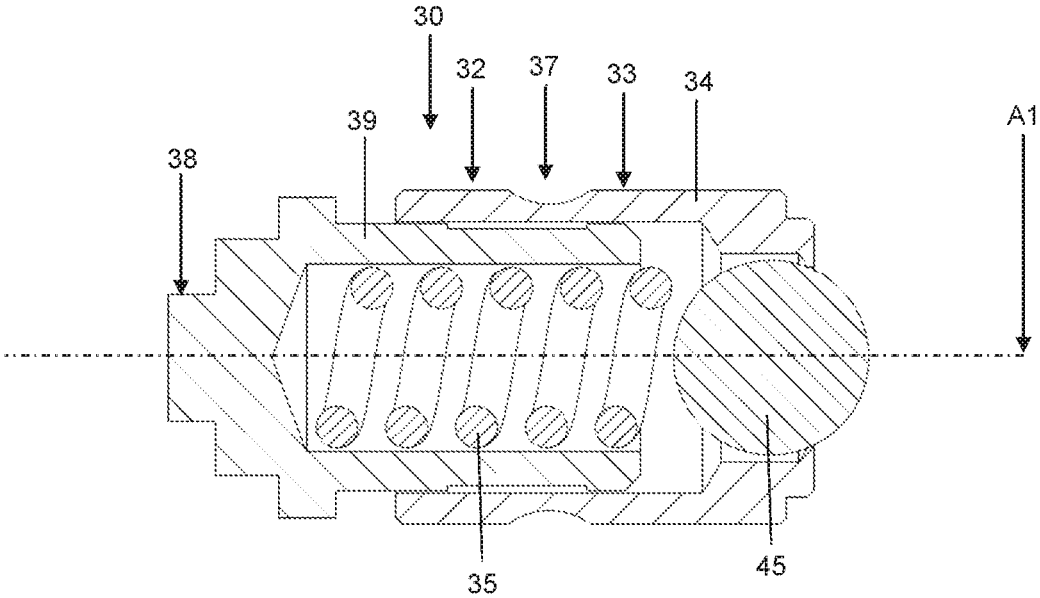
FIG. 10 depicts a view in cross section of a guidance and fastening system belonging to a third embodiment of the invention.

The guidance and fastening system 30, particularly depicted in FIG. 10, comprises a bar 32 comprising a first hollow pin 34 provided with an exterior periphery 33 intended to guide an adjusting link element 23. The bar 32 comprises a second hollow pin 39, housed within the first hollow pin 34, intended to connect an adjusting link element 23 to a clasp cover 24, notably via a stud 38 arranged at a first end of the bar 32. The two hollow pins are joined together by riveting 37. A helical spring 35 is incorporated into the hollow volume of the bar 32, in a preloaded configuration. It collaborates with a ball 45 positioned partly within the hollow volume of the bar, such that it can move, and partly protruding out from the bar 32, at its second end. At rest, as depicted in FIG. 10, the helical spring 35 applies to the ball 45 a force oriented towards the outside of the bar 32. The ball 45 is thus kept in abutment against an interior lateral wall of the bar while at the same time protruding at the second end of the bar 32.

Figure 11:
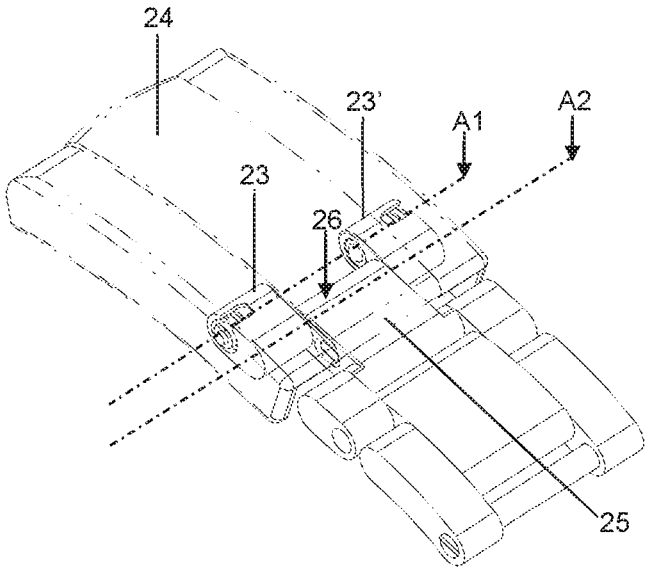
FIG. 11 depicts a perspective view of the clasp in the region of a device for adjusting the length of a bracelet incorporating the guidance and fastening system belonging to the third embodiment of the invention, in the long configuration.

FIG. 11 illustrates a bracelet length adjustment device, which incorporates two guidance and fastening devices 30, 30' as described hereinabove to connect two adjusting link elements 23, 23' to the cover 24 of the clasp, about an axis of rotation A1. FIG. 11 illustrates the long configuration of the bracelet, in which configuration a second axis of rotation A2 connected to the two adjusting link elements 23, 23' is oriented towards the outside of the clasp. An end link element 25 of the bracelet is fixed to a pivot pin 26 arranged around this second axis of rotation A2.

Figure 12:
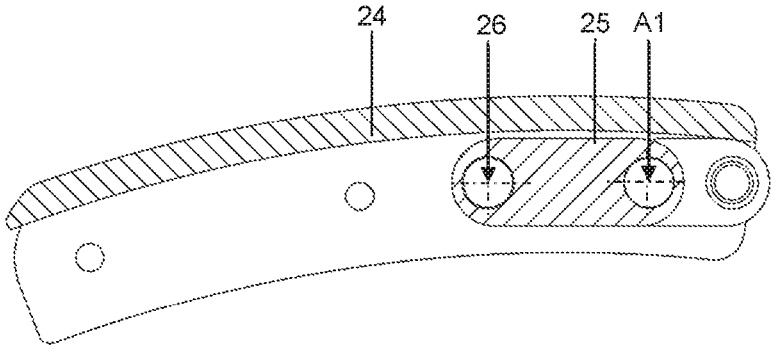
FIG. 12 depicts a view in longitudinal section of the clasp in the region of a device for adjusting the length of a bracelet incorporating the guidance and fastening system belonging to the third embodiment of the invention, in the short configuration.

FIG. 12 illustrates in cross section the short configuration of the device for adjusting the length of a bracelet. It is obtained by rearward rotation of the adjusting link elements about the axis A1, with guidance about the peripheral surface of the bar 32. The principle is similar to the one described with reference to the first embodiment.

Figure 13:
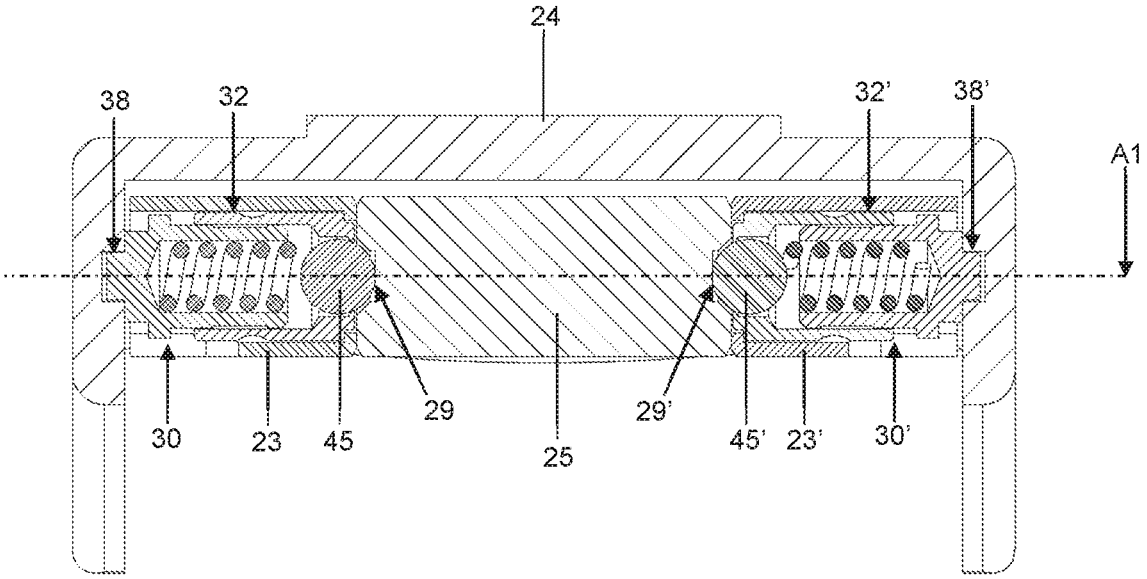
FIG. 13 depicts a view in cross section of the clasp in the short configuration in the region of the guidance and fastening system belonging to the third embodiment of the invention.
Figure 14:
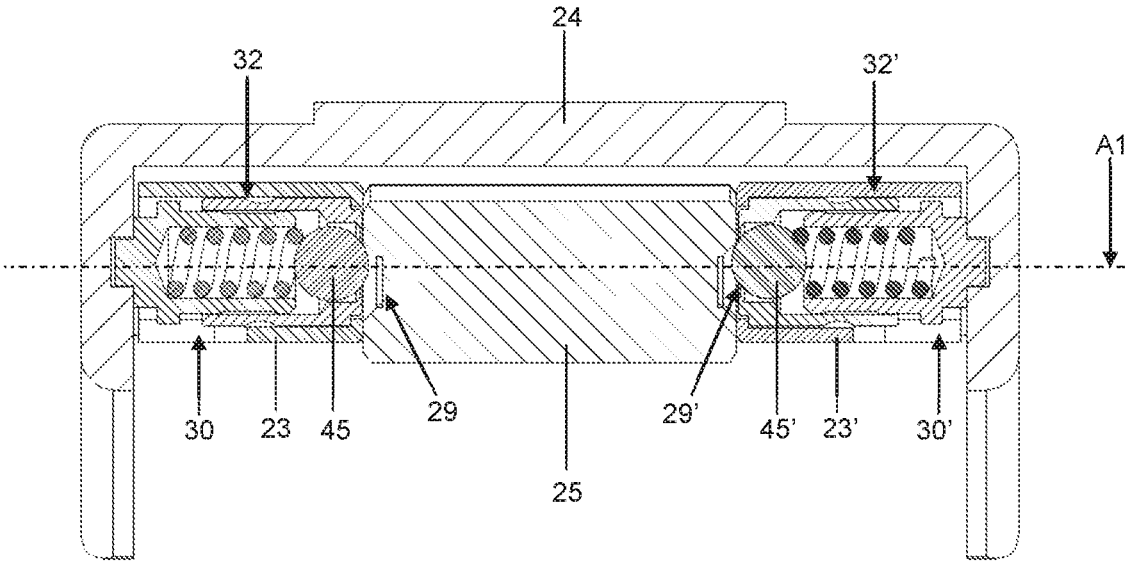
FIG. 14 depicts a view in cross section of the clasp in the actuation phase in the region of the guidance and fastening system belonging to the third embodiment of the invention.

FIG. 13 illustrates the elastic fastening function of the guidance and fastening system 30 in the short configuration of the device for adjusting the length of the bracelet. In this configuration, the end link element 25 collaborates with the balls 45 of the guidance and fastening system 30. This end link element 25 has the particular feature of comprising at least one notch 29, 29', recessed into one of its lateral walls. Each notch 29, 29' may for example take the form of a cutout delimited by one or more flanks that are inclined with respect to the lateral walls of the link element 25. Thus, actuation of the adjustment device in order to change the bracelet from its long configuration to its short configuration causes each of the helical springs 35 to be compressed through contact between the walls of the end link element 25 and the balls 45. The latter are pushed back towards the inside of the hollow volume of the bar 32, against the thrusting force of the helical springs 35. This actuation is illustrated by FIG. 14, which depicts an intermediate situation in which the said walls are acting on the balls. In the final position, illustrated by FIG. 13, the balls 45, 45' are housed within a respective notch 29, 29' of the two lateral walls of the end link element 25. The compressed springs 45 are there to guarantee that this configuration is kept stable and to thus perform the elastic fastening function.

Thus, as is clear from the foregoing description, the guidance and fastening system also combines two distinct devices, for guidance and for fastening, respectively. The guidance device comprises the bar 32 and, more specifically, at least part of the peripheral surface thereof, as well as possibly the first end thereof. The fastening device comprises the helical spring 35 and the ball 45. The two guidance and fastening functions are thus performed independently of one another. The fastening function is additionally independent of the link elements used, notably independent of the material used for the link elements of the bracelet. The retaining force is defined only by the elastic deformation of the springs 35, with no risk of plastic deformation of the notch or notches, nor any risk of causing the bar 12 to flex.

Furthermore, the bar 32 is substantially cylindrical, about an axis A1, and provides rotational guidance of an adjusting link element 23 about this axis A1. In addition, the helical spring 35 and the ball 45 are arranged along this same axis A1, the spring working in compression in the direction of the axis A1. The ball 45 is able to move in the direction of the axis A1. The helical spring 35 and the ball 45 are thus arranged about the axis A1. The bar 32 surrounds the helical spring and the ball 45. The axis A1 substantially forms an axis of symmetry for the elastic fastening device.

In this construction, the adjustment device uses two guidance and fastening systems 30, 30'. Of course, it is entirely possible to use an adjustment device provided with just one system, collaborating with just one notch.

Moreover, the balls 45, 45' of the guidance and fastening systems 30, 30' may be replaced by blocks or any other component the geometry of which is suited to constituting an appropriate interface between a spring and a notch: the term ball is therefore being used in the broadest sense, to include geometries which are not necessarily spherical.

FIGS. 15 to 18 illustrate a guidance and fastening system 40 belonging to a fourth embodiment of the length adjustment device of a bracelet within a clasp.

Figure 15:
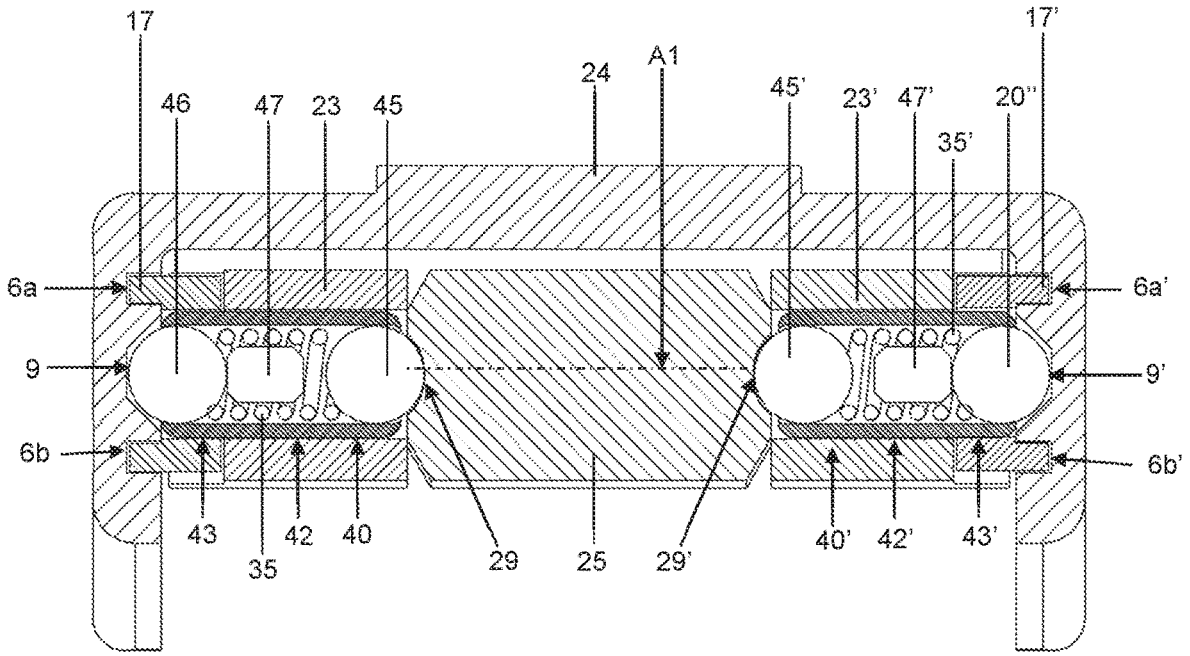
FIG. 15 depicts a clasp in the short configuration in cross section in the region of a guidance and fastening system belonging to a fourth embodiment of the invention.

Such a guidance and fastening system, particularly visible in FIG. 15, comprises a bar 42 forming a hollow pin. Part of its exterior periphery 43 is intended to guide an adjusting link element 23. A helical spring 35 is incorporated into the hollow volume of the bar 42, in a preloaded configuration. The helical spring 35 collaborates with two balls, a first ball 45 arranged at a first end of the bar oriented towards an end link element 25, and a second ball 46 arranged at a second end of the bar oriented towards a wall 2*c*1, 2*c*2 of the cover 24 of the clasp, these being positioned partly within the hollow volume of the bar 32, so that they can move, and so that they project out from the bar, at each end. Finally, the bar 42 comprises a mobile stop 47 between the two balls 45, 46. Observation: in this embodiment, as in the preceding one, the balls may be replaced by blocks or any other component the geometry of which is suited to constituting an appropriate interface between a spring and a notch.

FIG. 15 depicts a clasp comprising two guidance and fastening systems 40, 40' belonging to this fourth embodiment. These two guidance and fastening systems are aligned along the one same axis A1 and both collaborate with an end link element 25 in a central position, in a similar way to the clasp according to the preceding embodiment. FIG. 15 illustrates a fastening configuration in which the respective first balls 45, 45' of the two guidance and fastening systems 40, 40' are housed in a respective notch 29, 29' formed in each lateral wall of the end link element 25. In this configuration, each guidance and fastening system 40, 40' fastens the end link element 25 and holds the chosen adjustment configuration in a stable manner. Furthermore, the respective second balls 46, 46' of the two guidance and fastening systems 40, 40' are housed in notches 9, 9' formed respectively, notably by machining, on the vertical walls 2*c*1, 2*c*2 of the cover 24.

In this particular embodiment, unlike in the previous one, each bar 42, 42' is designed to be able to move in pairs of grooves 6*a*, 6*b* and 6*a*', 6*b*' formed in the lateral vertical walls 2*c*1, 2*c*2 of the cover of the clasp, as in the second embodiment of the invention described hereinabove. Thus, the exterior peripheries 43, 43' of the bars also form second guide surfaces which accept a guide pad 17, 17' designed to be able to be guided within the pairs of grooves 6*a*, 6*b* and 6*a*', 6*b*' of the cover of the clasp. The notches 9, 9' thus become superimposed on the path of the grooves 6, 6' so as to define several predetermined longitudinal positions of the link element 25 with respect to the clasp cover 24 along the path of the pairs of grooves 6*a*, 6*b* and 6*a*', 6*b*'. Thus, the bars 42, 42' can be guided by the grooves in a movement which follows the curvature of the cover 24, and which approximates to a longitudinal translation, and be stopped in position by the notches 9, 9'.

Figure 16:
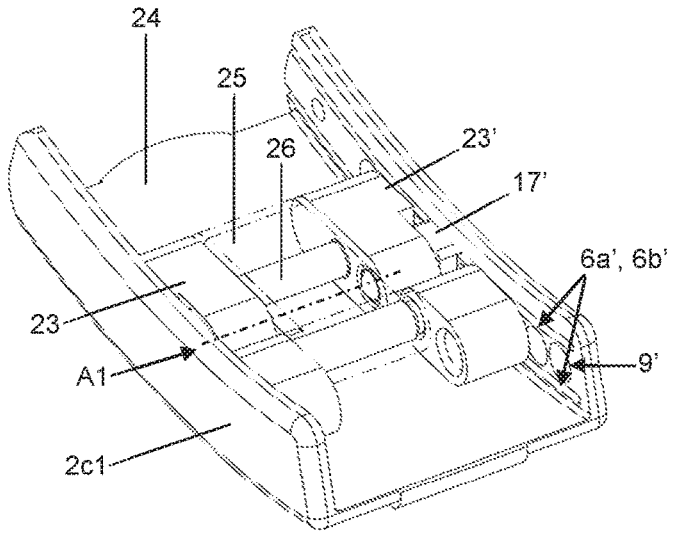
FIG. 16 depicts a perspective view of the clasp in the region of a device for adjusting the length of a bracelet incorporating the guidance and fastening system belonging to the fourth embodiment of the invention, according to a first adjustment.

In the configuration depicted in FIGS. 15 and 16, the lateral walls of the end link element 25 exert a force on the first balls 45, 45' of the two guidance and fastening systems. This force causes their internal springs 35, 35' to become compressed and transmits force to their second balls 46, 46', via their stops 47, 47'. In this way, the end link element 25 is elastically fastened by the two guidance and fastening systems 40, 40', and this fastening induces the second effect of fastening of the two systems in the cover of the clasp. Thus, each guidance and fastening system 40, 40' performs two simultaneous elastic fastening functions, on the one hand with a link element and on the other hand with the clasp, particularly the clasp cover 24.

When the central link element 25 is disengaged from its elastic fastening, it simultaneously releases the two aforementioned fastenings and this has the effect of allowing the adjusting link elements 23, 23' and their respective guidance and fastening systems 40, 40' to move longitudinally along the grooves.

Figure 17:
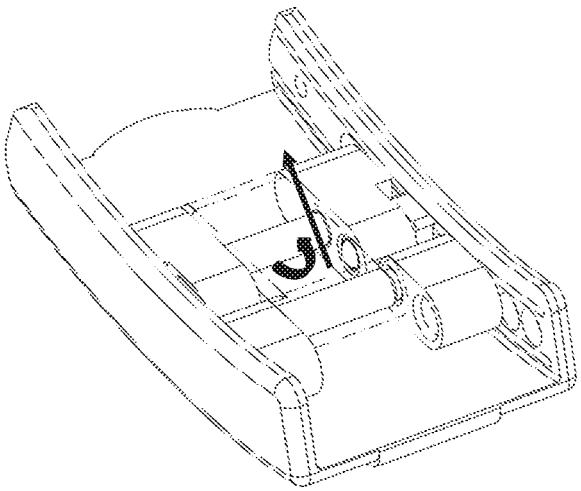
FIG. 17 depicts a perspective view of the clasp in the region of a device for adjusting the length of a bracelet incorporating the guidance and fastening system belonging to the fourth embodiment of the invention, according to a second adjustment.
Figure 18:
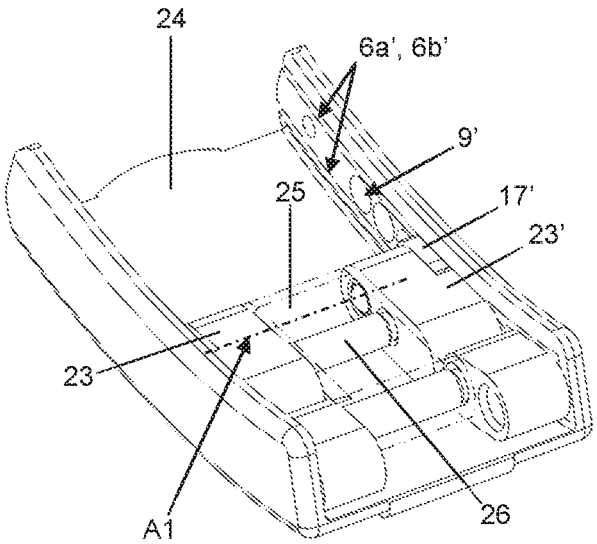
FIG. 18 depicts a perspective view of the clasp in the region of a device for adjusting the length of a bracelet incorporating the guidance and fastening system belonging to the fourth embodiment of the invention, according to a third adjustment.

As illustrated by FIG. 17, this architecture allows double adjustment. Specifically, in addition to being able to perform the movement described hereinabove in the guideways of the clasp, the adjusting link elements 23, 23' are additionally able to move in terms of rotation about the guidance devices, making it possible to obtain the same effect as in the first embodiment, namely a rotation of the end link element 25 with respect to the adjusting link elements 23, 23'. By way of illustration, FIG. 16 depicts a short configuration of the bracelet for a given position of the second balls 46, 46' within the notches 9, 9'. FIG. 18, on the other hand, depicts a long configuration of the bracelet for a given position of the second balls 46, 46' within the notches 9, 9'. In this configuration, the adjusting link elements 23, 23' are rotated through 180 degrees with respect to the position they occupy in FIG. 16, thus offering an additional extension.

Figure 19:
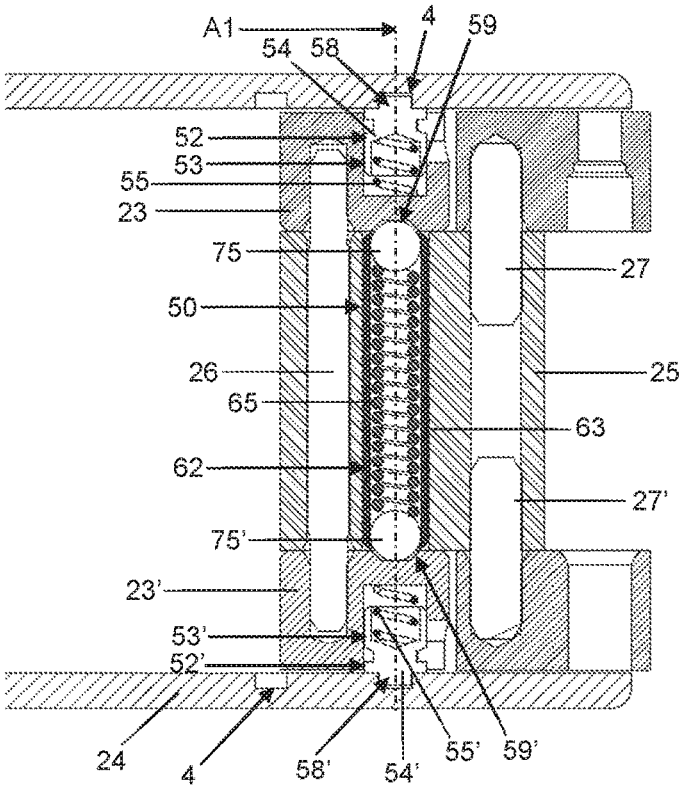
FIG. 19 depicts a view in section on a longitudinal plane of a clasp in the short configuration in the region of a device for adjusting the length of a bracelet incorporating the guidance and fastening system belonging to a fifth embodiment of the invention.
Figure 20:
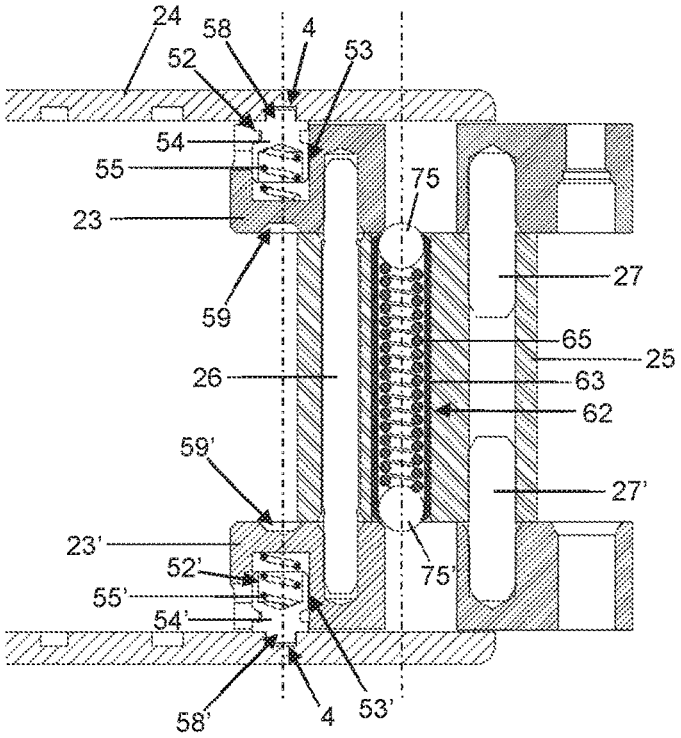
FIG. 20 depicts a view in section on a longitudinal plane of a clasp in the long configuration in the region of a device for adjusting the length of a bracelet incorporating the guidance and fastening system belonging to a fifth embodiment of the invention.

FIGS. 19 and 20 illustrate a guidance and fastening system 50 belonging to a fifth embodiment of the device for adjusting the length, similar to the one depicted in FIG. 13. The bracelet length adjustment device works in a similar way to the one described with reference to the third embodiment of the length adjustment device.

The guidance and fastening system 50, comprises a bar 52 taking on the role of a first hollow pin 54 provided with an exterior periphery 53 intended to guide an adjusting link element 23. The bar 52 thus forms a guidance device of the guidance and fastening system 50 according to this embodiment of the length adjustment device. This bar 52 is additionally intended to connect an adjusting link element 23 to a clasp cover 24, via a stud 58 arranged at a first end of the bar 52. A helical spring 55 is incorporated into the hollow volume of the bar 52, in a preloaded configuration when the cover 24 is assembled. Its function is to hold the stud 58 in a stable manner within a bore 4 arranged in a vertical wall of the cover 24 of the clasp.

As can be seen in FIGS. 19 and 20, the bracelet length adjustment device according to this embodiment incorporates two bars 52, 52' as described hereinabove to connect two adjusting link elements 23, 23' to the cover 24 of the clasp, about an axis of rotation A1. The adjusting link elements 23, 23' are additionally connected to an end link element 25, as in the preceding embodiments, by a connection articulated about a pin 26.

The adjusting link element additionally comprises a cylindrical opening in which there is housed a second bar 62, extending transversely across the entire width of the end link element 25. This second bar comprises a hollow pin 63, which incorporates a helical spring 65 in a preloaded configuration. This helical spring 65 collaborates with two balls 75, 75' positioned partly within the hollow volume of the pin 63, such that they can move, and partly protruding out from the pin 63, at its two lateral ends respectively.

At rest, as depicted in FIG. 20, the helical spring 65 applies to the balls 75, 75' a force oriented towards the outside of the bar 62. The balls 75, 75' are thus kept in abutment against an interior lateral wall of the pin 63 while at the same time protruding at the two ends thereof. This FIG. 20 illustrates the device for adjusting the length of a bracelet, in the long configuration of the bracelet, in which configuration a second axis of rotation A2 connected to the two adjusting link elements 23, 23' is oriented towards the outside of the clasp. An end link element 25 of the bracelet is fixed to the adjusting link elements 23, 23' by a pivot pin 26 arranged around this second axis of rotation A2.

FIG. 19 illustrates the device for adjusting the length of a bracelet, in the short configuration of the bracelet, in which configuration rearward rotation of the adjusting link elements 23, 23' about the axis A1, with guidance about the peripheral surface of the bars 52, 52' allows the pivot pin 26 to be positioned towards the inside of the clasp cover 24.

In this short configuration, the balls 75, 75' of the end link element 25 collaborate with notches 59, 59' recessed into the lateral walls of the adjusting link elements 23, 23', centred substantially on the axis A1, in the continuation of the axis of the bars 52, 52'. The notches 29, 29' may for example take the form of a cutout delimited by one or more flanks that are inclined with respect to the lateral walls of the adjusting link elements 23, 23'. The lateral walls of the adjusting link elements 23, 23' are preferably vertical.

Thus, actuation of the adjustment device in order to change the bracelet from its long configuration to its short configuration causes the helical spring 65 to be compressed through contact between the walls of the adjusting link elements 23, 23' and the balls 75, 75'. The latter are pushed back towards the inside of the hollow volume of the pin 63, against the thrusting force of the helical spring 65. In the final position, illustrated by FIG. 19, the balls 75, 75' are housed within a respective notch 29, 29' of the two lateral walls of the adjusting link elements 23, 23' respectively. The compressed spring 65 is there to guarantee that this configuration is kept stable and to thus perform the elastic fastening function. All the bars 52, 52', 62 in this solution are aligned along the one same transverse axis A1 in the short configuration and therefore during implementation of the fastening function. Thus, the second bar 62 incorporated into the end link element 25 represents a fastening device of the guidance and fastening system 50.

Observation: the vertical walls of the cover 24 offer several bores 4 distributed longitudinally so as to offer additional length adjustment simply by moving the link elements 23, 23' along and inserting their studs 58, 58' in one of these opposing bores 4.

Thus, as is apparent from the foregoing explanations, this fifth embodiment corresponds to the third embodiment in which the means forming the fastening function have been rearranged between the adjusting link elements 23, 23' and the end link element 25 in order to achieve equivalent operation and a similar result.

Thus, as before, the guidance and fastening system also combines two distinct devices, for guidance and for fastening, respectively. The guidance device comprises at least one bar 52 and, more specifically, at least part of the peripheral surface 53 thereof. The fastening device comprises the helical spring 65 and the balls 75, 75'. The two guidance and fastening functions are thus performed independently of one another. The fastening function is additionally independent of the link elements used, notably independent of the material used for the link elements of the bracelet. The retaining force is defined only by the elastic deformation of the spring 65, with no risk of plastic deformation of the notch or notches, nor any risk of causing the bar to flex.

As before, the balls 45, 45' of the guidance and fastening systems 30, 30' may be replaced by blocks or any other component the geometry of which is suited to constituting an appropriate interface between a spring and a notch: the term ball is therefore being used in the broadest sense, to include geometries which are not necessarily spherical.

Finally, the invention relies therefore on the optimal arrangement of an elastic fastening device, such as combined with a guidance device, in order to obtain a compact assembly that makes it possible to define improved performance and improved aesthetic results. This combining of the two guidance and fastening devices is advantageously performed about the one same axis, which may be an axis of symmetry and/or an axis of rotation during implementation of a guidance function. As an alternative, it is possible for these two devices not to exhibit axial symmetry. According to another alternative form, their axes could be slightly offset and parallel. Advantageously, one of the two devices at least partially surrounds the other device. These two devices may be combined in an arrangement arranged within the one same first element, for example a first bracelet link element or a first clasp leaf, intended to fasten to a second element, such as, for example, a second bracelet link element or a second clasp leaf. As an alternative, as illustrated by the fifth embodiment, the guidance device may be arranged in the first element and the elastic fastening device in the second element so that these two devices are aligned on the one same transverse axis in the position of fastening of the two elements.

What is meant by an elastic fastening device is a device which comprises at least one spring element, which deforms in order to fasten one component to one or more other component(s), in a manner that is elastically reversible. This elastic fastening may be performed against a bracelet link element, the said link element contributing passively (without deforming) to the fastening. This elastic fastening may be performed against a fixed part of a bracelet or of a clasp.

Furthermore, what is meant by a guidance device is a device provided with at least one means, notably a surface, for guiding one component with respect to a distinct component. This guidance may be rotation and/or movement in a groove, notably a movement corresponding substantially to a translational movement or movement corresponding to the curvature of a clasp cover. It may be achieved using a bracelet link element, particularly an adjusting link element, and/or a clasp.

In addition, according to one advantageous embodiment, the two guidance and fastening devices are independent, which means to say that they perform their respective functions without influencing the other device.

Naturally, the foregoing arrangements have been described by way of exemplary embodiments, and other architectures are conceivable without departing from the scope of the invention. For example, one or two guidance and fastening systems have been used with two adjusting link elements: as an alternative, a different number of guidance and fastening systems could be used, as could a different number of adjusting link elements. The guide surface forming part of the guidance systems could also be substituted by guidance means adopting, for example, the form of a number of ridges.

Advantageously, the guidance and fastening system is associated with a device for adjusting the length of a bracelet within a clasp, as described hereinabove. Advantageously, an adjusting link element and possibly at least part of an end link element are located under a cover formed by the clasp, this mechanism thus remaining hidden. The clasp may be of various types, having two or three deployment leaves.

As an alternative, the guidance and fastening system could simply be associated with one leaf of a clasp and could be used to articulate and fasten this leaf. The guidance and fastening system may thus be implemented for any system associated with a bracelet requiring variations in geometry. As a further alternative, the guidance and fastening system could be associated with a bracelet link element or link, whatever its position relative to the clasp.

The invention also relates to a bracelet and/or a clasp and/or a wristwatch incorporating at least one guidance and fastening system and a length adjustment device.

The invention claimed is:

1. A device for adjusting the length of a bracelet, comprising:

a guidance and fastening system comprising:

a guidance device, at least one adjusting link element mounted with the ability to rotate about an axis of rotation defined by the guidance device, and an elastic fastening device having an elastic property in order to perform an elastic fastening function, wherein the guidance device and the elastic fastening device are arranged around the axis of rotation, and wherein the elastic fastening device provides elastic immobilization of an end link element connected to the adjusting link element in at least one configuration of the adjustment device, the end link element collaborating with the elastic fastening device which elastically immobilizes the end link element with respect to the adjusting link element.

2. The device for adjusting the length of a bracelet according to claim 1, wherein the guidance device and the elastic fastening device are able to perform their respective functions independently of one another.

3. The device for adjusting the length of a bracelet according to claim 1, wherein the guidance device and the elastic fastening device extend coaxially along the axis of rotation.

4. The device for adjusting the length of a bracelet according to claim 1, wherein the guidance device and the elastic fastening device are formed at least in part of distinct components.

5. The device for adjusting the length of a bracelet according to claim 1, wherein the elastic fastening device comprises a spring.

6. The device for adjusting the length of a bracelet according to claim 1, wherein the guidance device comprises at least one bar.

7. The device for adjusting the length of a bracelet according to claim 1, wherein the guidance device comprises a bar forming a guide surface over at least part of a periphery thereof, and in a lateral region of the guidance and fastening system, and the elastic fastening device comprises a spring tube arranged in a central part of the guidance and fastening system and arranged around the bar, the spring tube being capable of elastic movement towards the bar, without touching the bar, in order to perform the elastic fastening function.

8. The device for adjusting the length of a bracelet according to claim 1, wherein the guidance device comprises a bar comprising at least one guide surface on a lateral part of the guidance and fastening system, and the elastic fastening device comprises a ball able to move parallel to the axis of the bar under the effect of a preloaded spring housed in a hollow volume of the bar, the ball being able to project from the bar.

9. The device for adjusting the length of a bracelet according to claim 8, wherein the bar has two ends and comprises a stud, arranged at one of the two ends, to make the stud capable of connecting an adjusting link element to a clasp cover, and the bar has an exterior periphery forming a guide surface capable of guiding an adjusting link element in pivoting movement with respect to a clasp cover.

10. The device for adjusting the length of a bracelet according to claim 1, wherein the device comprises a bar having at least one guide surface on a peripheral surface and two balls, one central and one lateral, able to move parallel to the axis of the bar at each end of the bar under the effect of a one same preloaded spring and a stop which are housed in a hollow volume of the bar, the balls being able to project from the bar.

11. The device for adjusting the length of a bracelet according to claim 1, wherein the guidance device comprises a bar comprising an end capable of connection with a clasp cover by pads and/or a stud and the guidance device has an exterior periphery forming a guide surface able to guide the adjusting link element with respect to the clasp cover.

12. Device for adjusting the length of a bracelet according to claim 11, wherein the guidance device comprises a guide surface able to guide the adjusting link element in rotation and/or approximately in translation with respect to the clasp cover.

13. The device for adjusting the length of a bracelet according to claim 1, wherein the adjusting link element comprises a second pivot pin having a second axis of rotation distinct from the axis of the rotation of the guidance and fastening system about which an end link element of a bracelet is arranged.

14. The device for adjusting the length of a bracelet according to claim 13, wherein (i) the end link element comprises at least one notch which compresses a spring tube of the guidance and fastening system in order to achieve elastic fastening thereof, or (ii) at least one wall of the end link element comprises a notch which comes into engagement with a ball preloaded by a spring in order to achieve elastic fastening thereof.

15. The device for adjusting the length of a bracelet according to claim 13, wherein the end link element comprises at least one notch which compresses a spring tube of the guidance and fastening system in order to achieve elastic fastening thereof, wherein the guidance device of the guidance and fastening system comprises a bar comprising a guide surface collaborating with the at least one adjusting link element in order to guide the pivoting thereof, and wherein the spring tube has, at at least one of ends thereof, a portion provided with a guide surface, which is placed to collaborate with a complementary guide surface belonging to the at least one adjusting link element so that the spring tube is independent of the bar and vice versa.

16. The device for adjusting the length of a bracelet according to claim 15, wherein the at least one adjusting link element comprises a bore that is open-ended for housing the bar and another bore forming the complementary guide surface and accommodating one end of the spring tube.

17. The device for adjusting the length of a bracelet according to claim 1, wherein the guidance device is arranged inside an adjusting link element and wherein the elastic fastening device is arranged within an end link element so that the guidance device and the elastic fastening device are aligned on the axis of rotation which is a transverse axis, in a position of mutual fastening of the guidance device and the elastic fastening device.

18. A deployment clasp for bracelet, wherein the clasp comprises at least one adjustment device according to claim 1.

19. A bracelet, wherein the bracelet comprises a deployment clasp according to claim 18.

20. A wristwatch wherein the wristwatch comprises at least one bracelet according to claim 19.

21. The device for adjusting the length of a bracelet according to claim 1, wherein the guidance device and the elastic fastening device are arranged around the axis of rotation upon implementation of the elastic fastening function.

* * * * *